US010200799B2

(12) United States Patent
Flaig et al.

(10) Patent No.: US 10,200,799 B2
(45) Date of Patent: Feb. 5, 2019

(54) HEARING DEVICE WITH SEALED MICROPHONE OPENING

(71) Applicant: SIVANTOS PTE. LTD., Singapore (SG)

(72) Inventors: Uwe Flaig, Feucht (DE); Wolfgang Schleifer, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/152,090

(22) Filed: May 11, 2016

(65) Prior Publication Data

US 2016/0337764 A1 Nov. 17, 2016

(30) Foreign Application Priority Data

May 13, 2015 (DE) ..... 10 2015 208 846

(51) Int. Cl.
*H04R 25/00* (2006.01)
*H04R 1/08* (2006.01)

(52) U.S. Cl.
CPC ..... *H04R 25/604* (2013.01); *H04R 1/086* (2013.01); *H04R 25/554* (2013.01); *H04R 25/65* (2013.01); *H04R 25/654* (2013.01); *H04R 2225/021* (2013.01); *H04R 2225/51* (2013.01)

(58) Field of Classification Search
CPC .... H04R 25/604; H04R 1/086; H04R 25/554; H04R 25/65; H04R 25/654; H04R 2225/021; H04R 2225/51
USPC ..... 381/315
See application file for complete search history.

(56) References Cited

U.S. PATENT DOCUMENTS

| | | | |
|---|---|---|---|
| 4,440,982 | A | 4/1984 | Kaanders et al. |
| 8,238,594 | B2 | 8/2012 | Sauer et al. |
| 8,416,975 | B2 | 4/2013 | Ho et al. |
| 8,542,858 | B2 | 9/2013 | Flaig et al. |
| 9,380,367 | B2 | 6/2016 | Gebert et al. |
| 2004/0196996 | A1 | 10/2004 | Feitel |
| 2005/0244024 | A1 | 11/2005 | Fischer et al. |
| 2006/0042865 | A1 | 3/2006 | Berg et al. |
| 2011/0013799 | A1 | 1/2011 | Fang et al. |
| 2015/0372532 | A1 | 12/2015 | Hatanaka et al. |

FOREIGN PATENT DOCUMENTS

| | | | |
|---|---|---|---|
| CN | 1684548 | A | 10/2005 |
| CN | 201491215 | U | 5/2010 |
| CN | 103069845 | A | 4/2013 |

(Continued)

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

A hearing device has a microphone for detecting an acoustic signal from the environment of the hearing device, and a housing in which the microphone is arranged. The housing is formed with a microphone opening through which the microphone communicates with the environment of the hearing device for detecting the acoustic signal. The hearing device further has a damping element, by way of which the microphone is supported against the housing. Moreover, the hearing device has a barrier element for sealing the microphone opening against moisture in a sound-transmitting manner. The damping element has a pocket in which the barrier element is received reversibly. Furthermore, the barrier element is sealed off from the housing by way of the damping element all around the microphone opening.

18 Claims, 4 Drawing Sheets

(56) References Cited

FOREIGN PATENT DOCUMENTS

| | | | |
|---|---|---|---|
| DE | 102010009782 | A1 | 9/2011 |
| DE | 102013213891 | A1 | 11/2014 |
| EP | 1465457 | A2 | 10/2004 |
| EP | 1587343 | A2 | 10/2005 |
| EP | 1629805 | A1 | 3/2006 |
| EP | 2068587 | A2 | 6/2009 |
| EP | 2334102 | A2 | 6/2011 |
| GB | 2096863 | A | 10/1982 |
| JP | 2014161177 | A | 9/2014 |
| WO | 2009123563 | A1 | 10/2009 |
| WO | 2011046508 | A1 | 4/2011 |
| WO | 2014188297 | A1 | 11/2014 |

HEARING DEVICE WITH SEALED MICROPHONE OPENING

CROSS-REFERENCE TO RELATED APPLICATION

This application claims the priority, under 35 U.S.C. § 119, of German patent application DE 10 2015 208 846.4, filed May 13, 2015; the prior application is herewith incorporated by reference in its entirety.

BACKGROUND OF THE INVENTION

Field of the Invention

The invention relates to a hearing device and, in particular, to a hearing aid.

A hearing device, in particular a hearing aid, usually allows a person with impaired hearing to compensate for at least some of their hearing loss. For this purpose, the hearing device in most cases comprises at least one microphone, by means of which noises (acoustic signals) from the environment of the hearing device (and thus also from the environment of the person wearing the hearing device) are detected and converted into an electrical signal. In a signal processing unit of the hearing device, this electrical signal is conventionally amplified, if appropriate after filtering of interference signals, and sent via a loudspeaker (often also referred to as a "receiver") to the ear of the person wearing the hearing device. Alternatively, the signals can also be transmitted to the auditory center of the person wearing the hearing device via a cochlear implant, a bone conduction implant or the like.

The hearing device is usually worn on the body, particularly in or on the ear in which hearing is impaired. However, on the body of the person wearing the hearing device, particularly on the head of the person wearing the hearing device, the latter is often subject to the effect of dirt (for example dust) and/or liquids (perspiration, rainwater or also earwax). Depending on the degree of hearing impairment and/or the wishes of the particular person wearing the hearing device, it can also happen that the hearing device comes directly into contact with water, e.g. when taking a shower or when in a swimming pool.

However, the microphone of the hearing device and the signal processing unit thereof are electronic components whose function can be adversely affected or even completely destroyed by direct contact with moisture. In order to provide basic protection of these electronic components, the hearing device generally comprises a housing which encloses these electronic components. However, to be able to detect the acoustic signals from the environment as precisely as possible, the housing usually has a microphone opening which is assigned to the microphone of the hearing device and through which the acoustic signals (sound waves) can reach the microphone as far as possible unimpeded. However, to be able to protect the microphone from entry of moisture or other contaminants, the microphone opening is often closed by means of a barrier that is largely impermeable to water. This barrier is in most cases made thin, so that the incoming sound waves are attenuated as little as possible. The thickness of such barriers is up to about 50 μm.

It is known that soiling of the barrier, for example by earwax, leads to reduced sound transmission, such that the barrier has to be replaced, sometimes also as a result of damage to the barrier. Therefore, such a barrier is inserted into the housing in such a way as to be exchangeable. In addition, however, the barrier also has to be sealed off from the housing. Alternatively, however, such a barrier is also produced integrally with the housing or is adhesively bonded (non-detachably) thereto to provide a tight closure.

SUMMARY OF THE INVENTION

It is accordingly an object of the invention to provide a hearing device which overcomes the above-mentioned and other disadvantages of the heretofore-known devices and methods of this general type and which is provided with improved protection of a microphone against contamination.

With the foregoing and other objects in view there is provided, in accordance with the invention, a hearing device, comprising:

a housing, the housing having a microphone opening formed therein;

a microphone disposed in the housing and communicating through the microphone opening with an environment of the hearing device for detecting an acoustic signal from the environment of the hearing device;

a damping element supporting the microphone against the housing; and a barrier element sealing the microphone opening against moisture in a sound-transmitting manner;

the damping element having a pocket wherein the barrier element is received reversibly; and the damping element sealing off the barrier element from the housing around an entire periphery of the microphone opening, i.e., all around the opening.

Due to the fact that the exemplary embodiment of the invention is a hearing device with two microphones, the following terms will be used herein: the microphone is a first microphone, the microphone opening is a first microphone opening, the damping element is a first damping element, and the barrier element is a first barrier element. In a preferred embodiment, the device further comprises a second microphone disposed in the housing; a second damping element and a second barrier element assigned respectively to the second microphone, wherein the second barrier element is received reversibly in a pocket formed in the second damping element. In that case, the first damping element and the second damping element are connected to one another in one piece.

In other words, the hearing device according to the invention comprises a first microphone for detecting an acoustic signal from the environment of the hearing device and preferably for converting the acoustic signal into an electrical signal. The hearing device further comprises a housing in which the first microphone is arranged. The housing in this case has a first microphone opening through which the first microphone for detecting the acoustic signal communicates (preferably acoustically) with the environment of the hearing device. The hearing device further comprises a first damping element, by means of which the first microphone is supported (preferably elastically) against the housing. The first damping element serves in particular to reduce vibrations of the first microphone and to reduce the coupling of structure-borne noise (transmitted via the housing) into the first microphone. Moreover, the hearing device comprises a first (preferably water-tight) barrier element for sealing the first microphone opening in a sound-transmitting manner. That is to say, the first barrier element serves to protect the first microphone and the interior of the housing against contaminants that can enter through the first microphone opening, in particular against moisture. The first damping element in this case has a pocket in which the first barrier element is received reversibly (i.e. exchangeably). Moreover, the first barrier element (in the correct state of final assembly of the hearing device) is sealed off from the housing by means of the first damping element all around the first microphone opening. For this purpose, an edge of the first damping element circumferentially delimiting the pocket of the first damping element preferably bears sealingly on the housing all around the first microphone opening.

The first damping element thus in the first instance forms a means of vibration damping for the first microphone and advantageously in addition a retainer and a seal for the first barrier element in relation to the housing. Particularly since the first barrier element is received reversibly in the pocket of the first damping element, it is possible for the first barrier element to be exchanged easily and cost-effectively as an individual part. Furthermore, it is also possible to cut out the assembly work involved in sealing (e.g. by adhesive bonding) the first barrier element in relation to the housing. Preferably, the first damping element is likewise arranged exchangeably in the housing, such that in this case the first barrier element can also be easily exchanged together with the first damping element.

Preferably, the housing of the hearing device has a shell-like design and is composed of at least two shell parts. This permits simple mounting of the first microphone, the first damping element and the first barrier element in the housing. In this case, the first microphone opening is preferably formed in the shell part lying nearest to the first microphone.

In a preferred embodiment, the first damping element is made from an elastic material, in particular from an elastic plastic, for example a (preferably thermoplastic) elastomer or a silicone, in particular a liquid silicone rubber (LSR). Preferably, the first damping element is injection molded from such a plastic. This permits simple production of the damping element while at the same time allowing a large degree of design freedom (i.e. complex structures can be easily configured).

In an expedient embodiment, the first damping element has an aperture which corresponds to the first microphone opening and through which the acoustic signal can reach the first microphone. The pocket for receiving the first barrier element is in this case preferably designed as an undercut of this aperture. Here, and in the text below, an "undercut" is understood as meaning that the aperture (seen along its longitudinal axis) within the wall thickness of the damping element initially widens and then narrows again. In an advantageous embodiment, at one of the two (distal) ends of the aperture, an in particularly annularly closed edge, which has a thin wall in relation to the length of the aperture, protrudes in the direction towards the longitudinal axis of the aperture. A second such edge is preferably also arranged at the opposite end. The undercut is in this case arranged between these edges and is delimited by these on both sides. The undercut is in particular configured in such a way that the first barrier element arranged in the undercut is held with a form fit, preferably by both edges, in any case at least by one edge. To seal the first barrier element off in relation to the housing (or in relation to the one shell part of the housing), the first damping element hears circumferentially on the housing with the edge delimiting the undercut to the front of the first damping, element, i.e. in the direction of the first microphone opening.

Preferably, the aperture in the first damping element and the first barrier element are each approximately circular (i.e. exactly round or slightly oval). To simplify matters, the internal dimensions of the aperture and the external dimensions of the first barrier element are therefore designated below generally as "internal diameter" and "external diameter", wherein these designations in the case of an oval aperture and oval first barrier element each stand for the smallest internal dimension or smallest external dimension thereof.

In accordance with an added feature of the invention, the aperture is enlarged at one of its distal ends (in relation to the respective other end). Preferably, the thin-walled edge of the first damping element, arranged at this enlarged end, does not protrude so far in the direction of the longitudinal axis of the aperture as the area of the aperture arranged on the other side of the undercut, in particular the "second" thin-walled edge optionally present there. The enlarged area of the aperture, in particular the edge arranged there, is dimensioned in such a way that the first barrier element inserted into the undercut is covered only slightly by this area or edge (by comparison with the external diameter of the first barrier element). This is particularly advantageous in the case where the first damping element is made from elastic plastic. In this case, the first barrier element can in fact be easily inserted into the pocket or the undercut via this edge of the aperture, utilizing the elastic deformation capacity of the latter, wherein the edge "snaps" onto the first barrier element.

In accordance with an alternative embodiment, the undercut is opened in a direction transverse to the longitudinal axis of the aperture, in such a way that an insertion well for the first barrier element is formed. That is to say, the first damping element has a window (the insertion well) which is arranged perpendicularly with respect to the direction of thickness of the damping element and which is formed all the way into the aperture from the side of the first damping element. In this way, the first barrier element can be pushed through the insertion well into the undercut from the side (i.e. perpendicularly with respect to the longitudinal axis of the aperture), without deformation or with only negligible deformation of the damping element. The areas of the aperture delimiting the undercut, in particular the respective edges, are in this case comparatively stiff and are designed protruding farther into the aperture (with greater width). That is to say, they cover the first barrier element (by comparison with the embodiment described above) over a larger surface area and thus hold the latter in the undercut in a particularly stable manner and tightly.

In another expedient embodiment, the pocket or the undercut of the first damping element is dimensioned in such a way that the first barrier element (inserted into the pocket) is braced against the first damping element. For example, the internal diameter of the undercut is in this case slightly smaller than the external diameter of the barrier element. In this way, in addition to the form-fit engagement in the manner of an interference fit, the barrier element is also held with a force fit in the first damping element. Moreover, the sealing action between the damping element and the barrier element is also increased in this way. Alternatively or in addition, the space between the two edges delimiting the undercut is made smaller than the thickness of the barrier element.

In a preferred embodiment, the first barrier element comprises an in particular hydrophobic membrane. This membrane expediently transmits sound. In particular, the membrane is formed by a finely porous material (e.g. a mesh or nonwoven material). This material is preferably hydrophobic per se or at least has a hydrophobic coating. Optionally, the membrane is additionally or alternatively water-impermeable, for example in the form of a polyether ester film or a microporous polytetrafluoroethylene (PTFE) film with a material thickness of in each case about 5 to 50 μm. This membrane is expediently held tight in an enclosing frame, which has a greater stiffness compared to the membrane. This permits a dimensional stability of the membrane and thus simple handling of the barrier element itself, without the risk of the membrane collapsing. The frame is in particular injected onto the membrane circumferentially.

In another preferred embodiment, the hearing device comprises a second microphone, such that directivity can be achieved by means of suitable circuitry of both microphones. The hearing device further comprises in particular a second damping element and second barrier element assigned respectively to the second microphone. The second damping element and the second barrier element are preferably of the same design as the first damping element and the first barrier element described above. In this embodiment, the first damping element and the second damping element are expediently also connected to each other in one piece, e.g. via a connecting web formed integrally (i.e. monolithically) with the first damping element and the second damping element. In particular, the first damping element and the second damping element are produced jointly in an injection-molding process or a vulcanizing process (including the connecting web). The ease of handling of the first damping element and second damping element is advantageously enhanced by the one-piece embodiment, since only one component, namely the "damper part" comprising the first damping element and second damping element, is present. It is also possible in this case to exchange this damper part together with the two barrier elements, which is in turn advantageous in respect of the ease of handling of the comparatively small barrier elements.

In another expedient embodiment, the hearing device comprises an antenna for electromagnetic (in particular radio) communication with a separate device. Said separate device is, for example, a control device for predefining hearing device settings, an external audio signal source (e.g. a smartphone, a TV device or the like) or a second hearing device, which is designed and provided to affect both ears of the person wearing the hearing device. In this case, the antenna is in particular integrated in the first and/or second damping element, but preferably in the damper part formed by the first damping element and second damping element. For example, the antenna is injected as a metallic insert part into this damper part, in particular into the connecting web of the latter (i.e. encapsulated with the plastic of the first damping element and second damping element). This achieves a functional integration of several separate components of the hearing device in one component, and the handling of the components during assembly is thus simplified.

In another expedient embodiment, the hearing device comprises a circuit carrier which in particular carries a signal processing unit, for evaluation and amplification of the detected acoustic signals, and also conductor tracks, for electrically contacting the first microphone and, if appropriate, the second microphone and the antenna to the signal processing unit. The antenna is in this case preferably connected by means of a solder connection to an assigned conductor track of the circuit carrier. Alternatively, the antenna is connected to the corresponding conductor track by means of a plug connection, a clamp connection, a spring contact or the like.

Other features which are considered as characteristic for the invention are set forth in the appended claims.

Although the invention is illustrated and described herein as embodied in a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Parts corresponding to each other are always provided with the same reference signs in all of the figures.

DETAILED DESCRIPTION OF THE INVENTION

Figure 1:
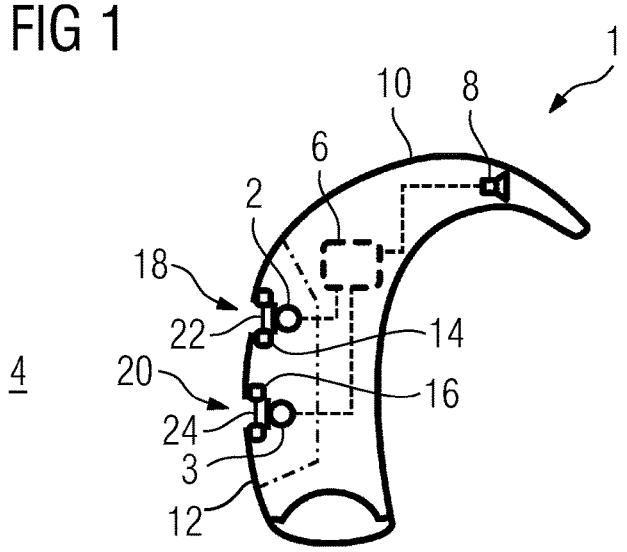
FIG. 1 is a schematic view of a hearing device with a first microphone and a second microphone.

Referring now to the figures of the drawing in detail and first, particularly, to FIG. 1 thereof, there is shown a hearing device 1 in the form of a hearing aid. The hearing device 1 is a so-called behind-the-ear (BTE) hearing device and is therefore worn behind the pinna or auricle of a person wearing the hearing device. The hearing device 1 comprises a first microphone 2 and a second microphone 3, which are each designed and provided to detect an acoustic signal from the environment 4 of the hearing device 1. Furthermore, the first microphone 2 and second microphone 3 are configured to convert the detected acoustic signal into an electrical signal and forward same to a signal processing unit 6 of the hearing device 1. In the signal processing unit 6, the respective electrical signal is evaluated, filtered and then forwarded in amplified form to a loudspeaker 8 (also referred to as a "receiver") of the hearing device 1. By means of the loudspeaker 8, the amplified signal is converted into a corresponding acoustic (output) signal and sent to the ear of the person wearing the hearing device by way of a flexible sound tube. The two microphones 2 and 3, the signal processing unit 6 and the loudspeaker 8 each form an electronic component of the hearing device 1 and, to provide basic protection against environmental influences (contaminants), are arranged in a housing 10 of the hearing device 1. The housing 10 has a shell design and, to permit assembly of the two microphones 2 and 3 and of the other electronic components, comprises a separable shell part, which is referred to hereinbelow as cover 12 (indicated by the dot-and-dash line in FIG. 1).

To avoid transmission of vibrations of the housing 10 to the two microphones 2 and 3, the latter are supported elastically (resiliently) against the housing 10, specifically against the cover 12, by means of first and second damping elements 14 and 16 (assigned to the microphone 2 and the microphone 3, respectively). The two damping elements 14 and 16 here are injection-molded from an elastic plastic, specifically from a silicone (LSR).

As can be seen in FIG. 1, the two microphones 2 and 3 are arranged beneath the cover 12, i.e., they are concealed by the latter. To ensure that the acoustic signals emanating from the environment 4 can be received with the least possible attenuation, a first microphone opening 18 and a second microphone opening 20 are formed in the cover 12, these openings being assigned respectively to the first microphone 2 and the second microphone 3.

To prevent entry of contaminants, specifically of liquid such as water or perspiration, through the two microphone openings 18 and 20, and thereby to protect the two microphones 2 and 3 from dirt and moisture, the hearing device 1 further comprises two barrier elements 22 and 24 (assigned respectively to microphone 2 and microphone 3). These barrier elements 22 and 24 are in this case each mounted reversibly (i.e. exchangeably) in the respective damping element 14, 16. The respective barrier element 22, 24 is sealed off from the housing 10, specifically the cover 12, via the respective damping element 14, 16.

Figure 2:
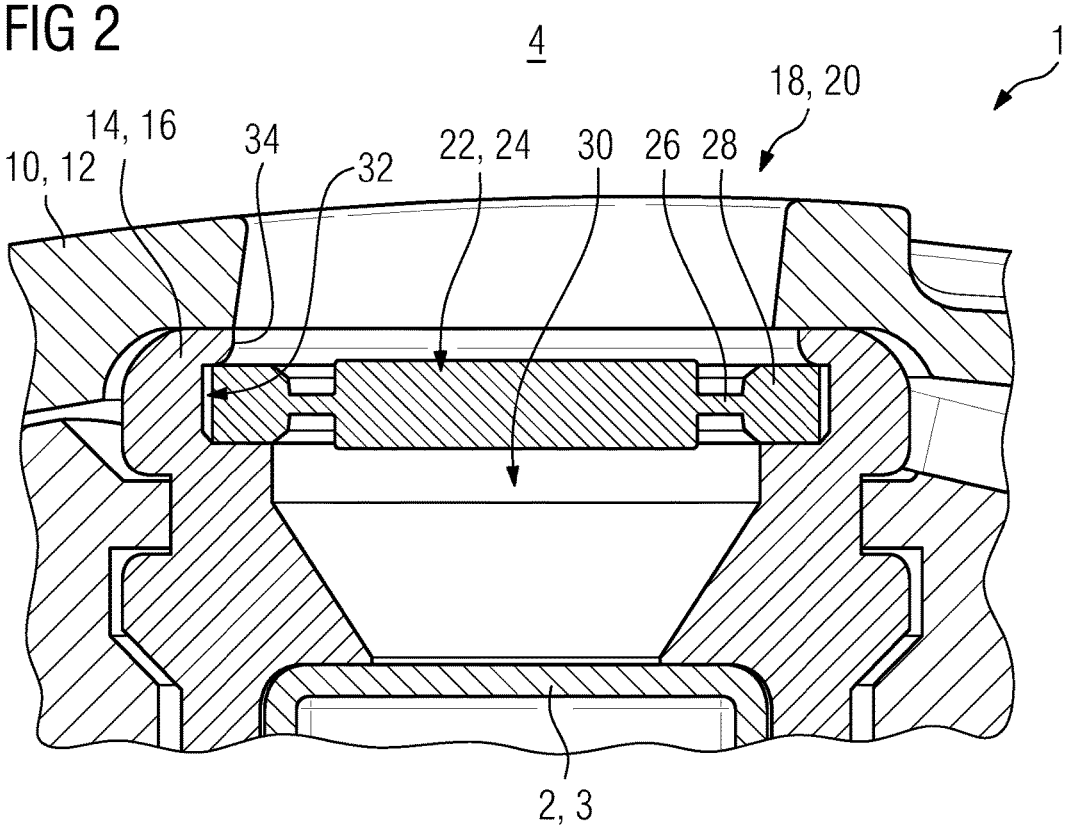
FIG. 2 is an enlarged sectional cutout view of one of the two microphones of the hearing device with a damping element and a barrier element.

As can be seen from FIG. 2, the barrier element 22, 24 comprises a hydrophobic but sound-transmitting membrane 26, which is held and tensioned by an annularly closed frame 28 formed integrally on the membrane 26 by injection molding. The respective barrier element 22, 24 is designed with a circular outer contour (cf. FIG. 4).

As can also be seen from FIG. 2, the damping element 14, 16 engages around the respective microphone 2, 3 at the front side and braces the latter elastically against the housing 10 or the cover 12. The damping element 14, 16 has a hollow cylindrical design and thus has a circular aperture 30 which corresponds to the respective microphone opening 18, 20 and through which acoustic signals can pass to the microphone 2, 3. The aperture 30 is formed with an undercut 32, i.e. a partial enlargement of the internal diameter of the aperture 30. This undercut 32 forms a pocket for receiving the frame 28 of the barrier element 22, 24. The barrier element 22, 24 is held in the undercut 32 with a form fit by a thin-walled edge 34 (thin by comparison with the length of the aperture 30) of the damping element 22, 24, which edge 34 protrudes inward into the aperture 30. Moreover, in the correct state of final assembly of the hearing device 1 according to FIG. 2, this edge 34 bears on the inner face of the cover 12 all around the respective microphone opening 18, 20, such that passage of moisture between the cover 12 and the barrier element 22, 24 is prevented.

The edge 34 of the damping element 14, 16 is designed in such a way that, in relation to the external diameter of the (circular) barrier element 22, 24, it protrudes only slightly over the frame 28 thereof. In this way, in order to permit assembly or disassembly, the barrier element 22, 24 can be pushed into the undercut 32 after overcoming the elastic restoring force of the edge 34 (i.e. with slight elastic deformation thereof), wherein the edge 34 "snaps on" over the frame 28.

Figure 3:
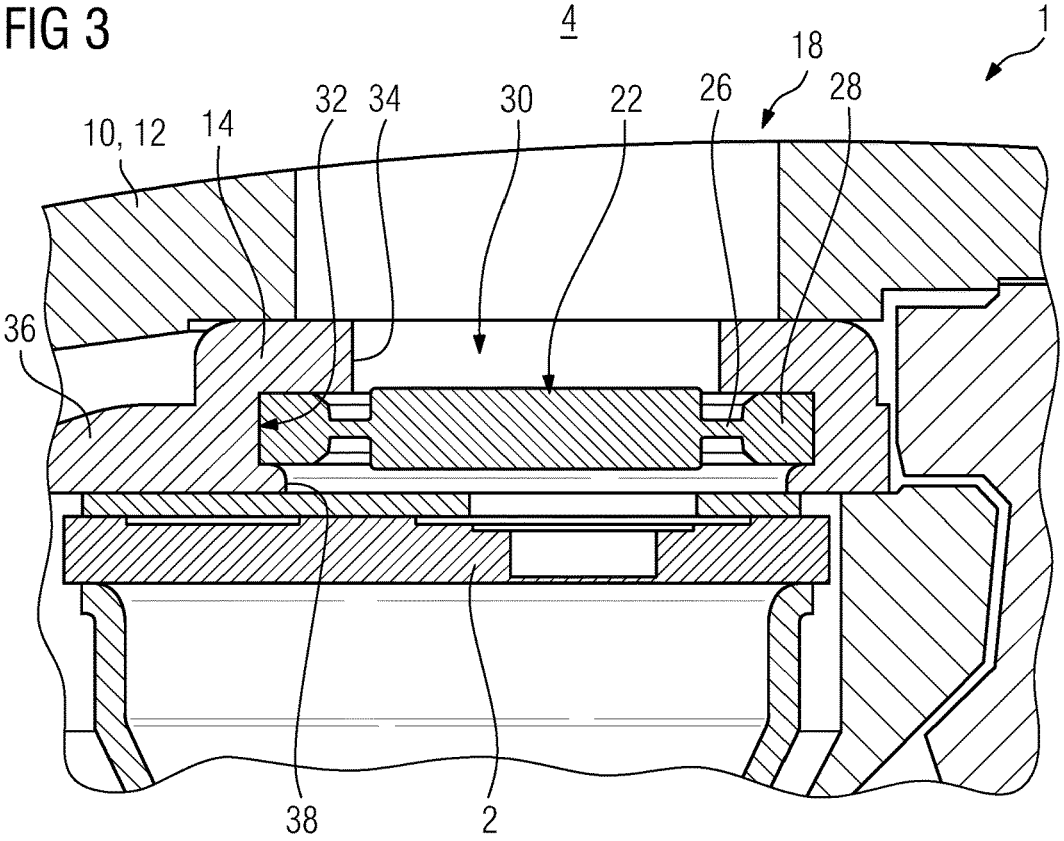
FIG. 3 is a similar view illustrating an alternative exemplary embodiment of the damping elements of the two microphones.

FIG. 3 shows an alternative illustrative embodiment of the damping elements 14 and 16. Compared to the illustrative embodiment according to FIG. 2, the damping elements 14 and 16 here have a shallow design and bear only at the front on the respective microphone 2, 3 (cf. FIG. 3). Moreover, the two damping elements 14 and 16 are connected integrally to each other via a connecting web 36. This results in improved handling of both damping elements 14 and 16. As can be seen from FIG. 3, the undercut 32 of the two damping elements 14 and 16 is arranged more or less centrally with respect to the length of the aperture 30 in the respective damping element 14, 16. Thus, in the direction of the microphone opening 18, 20 (hereinbelow designated as the front of the respective damping element 14, 16), the undercut 32 is delimited by the edge 34. At the rear, the undercut 32 is delimited by a further edge 38 completing the aperture 30 and the damping element 14, 16. The edge 38, in the same way as the edge 34, has a small wall thickness compared to the length of the aperture 30. In the illustrative embodiment according to FIG. 3, the rear edge 38, analogously to the edge 34 of the illustrative embodiment according to FIG. 2, is designed with a comparatively large internal diameter (i.e. with a small width). In other words, the internal diameter of the edge 38 is slightly smaller than the external diameter of the barrier element 22, 24, such that the respective barrier element 22, 24 in this illustrative embodiment can be inserted from the rear into the undercut 32 (with deformation of the edge 38). By contrast, the edge 34 is designed with a smaller internal diameter and is comparatively stiff, such that the edge 34 does not have a sufficiently high elastic deformation capacity to permit insertion of the respective barrier element 22, 24 from the front.

Figure 4:
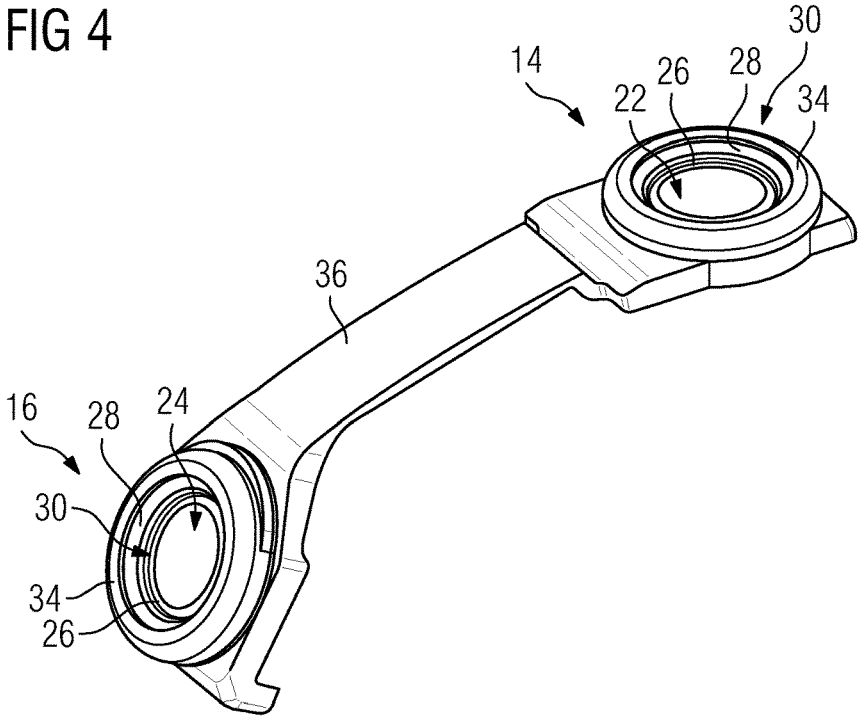
FIG. 4 shows a perspective detailed view of a further illustrative embodiment of the damping elements.

By contrast, in a modified illustrative embodiment according to FIG. 4, the front edge 34, analogously to the illustrative embodiment according to FIG. 2, is designed such that the respective barrier element 22, 24 can be inserted from the front into the respective undercut 32 of the damping elements 14 and 16. The rear edge 38 here is once again designed with a smaller internal diameter than the edge 34 and is thus also stiffer than the latter.

Figure 5:
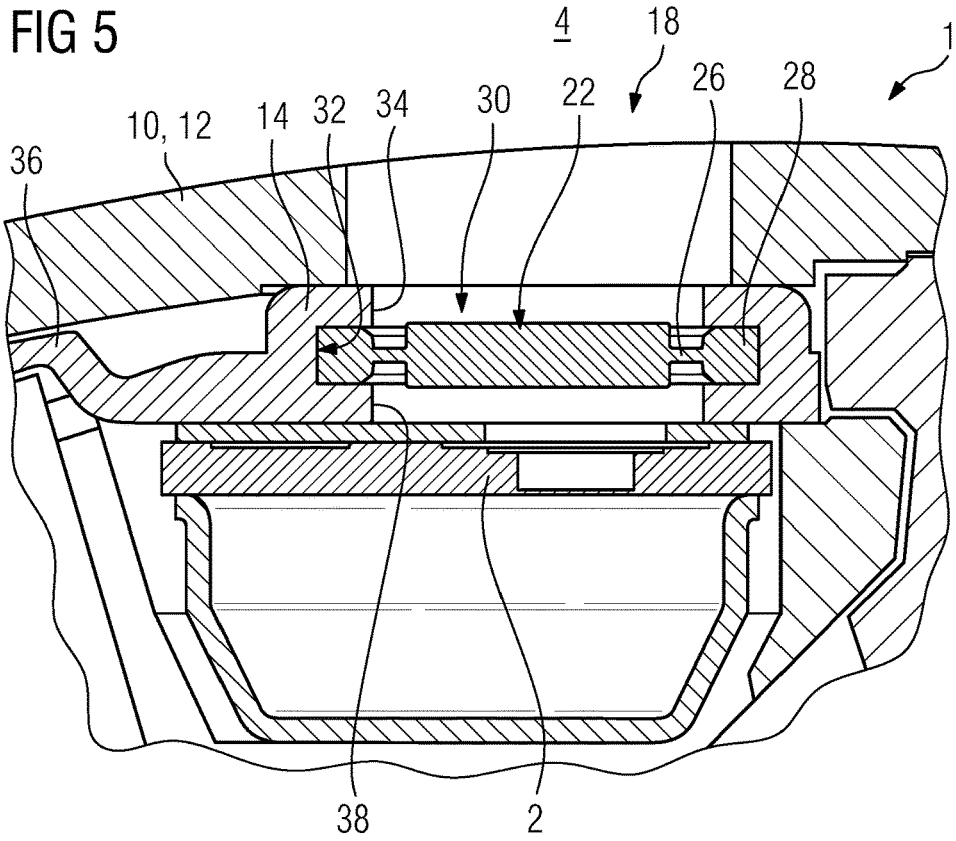
FIG. 5 shows, in a view corresponding to that of FIG. 2, a further illustrative embodiment of the damping elements.
Figure 6:
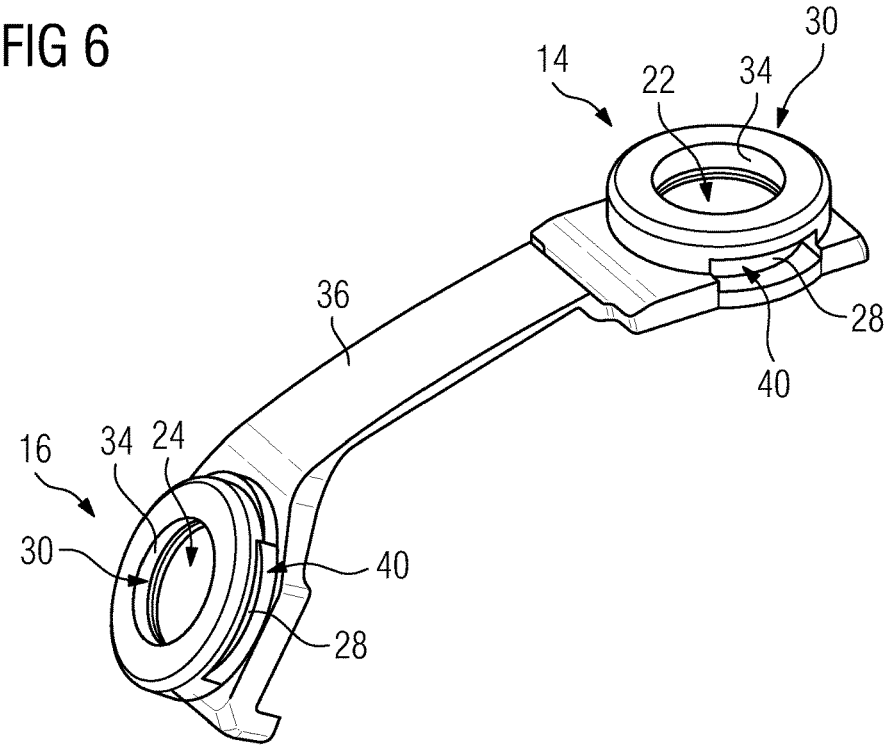
FIG. 6 is a view similar to that of FIG. 4, illustrating one of the damping elements according to FIG. 5.

In a further alternative illustrative embodiment according to FIGS. 5 and 6, the edges 34 and 38 are designed in such a way that the respective barrier element 22, 24 cannot be inserted into the undercut 32 with elastic deformation of one of the two edges 34, 38. Specifically, the respective internal diameter of the two edges 34 and 38 is chosen to be small, such that their elastic deformation capacities are not sufficient for inserting the respective barrier element 22, 24 into the undercut 32. In this case, the respective damping element 14, 16 has an insertion well 40 through which the respective barrier element 22, 24 can be pushed into the undercut 32 from the side of the damping element 14, 16 (i.e. perpendicularly with respect to the longitudinal direction of the aperture 30). The insertion well 40 thus forms a window arranged at right angles to the aperture 30. Thus, in the correct state of assembly according to FIG. 5, the respective barrier element 22, 24 is held in a particularly stable manner between the two edges 34 and 38 (particularly on account of the pressure applied by the microphone 2, 3 in the direction of the cover 12), whereas simple assembly and disassembly of the respective barrier element 22, 24 is possible for maintenance and/or exchange purposes.

In a further illustrative embodiment not shown in more detail here, the hearing device 1 comprises a communication means for wireless communication with a further hearing device, for example for aiding both ears of one and the same person wearing the hearing device, or with a smartphone. Part of this communication means is formed by an antenna 42. In the correct state of assembly of the hearing device 1, the antenna 42 is galvanically connected to a circuit carrier, which also carries the signal processing unit 6 and a number of conductor tracks. To make it easier to handle, the antenna

Figure 7:
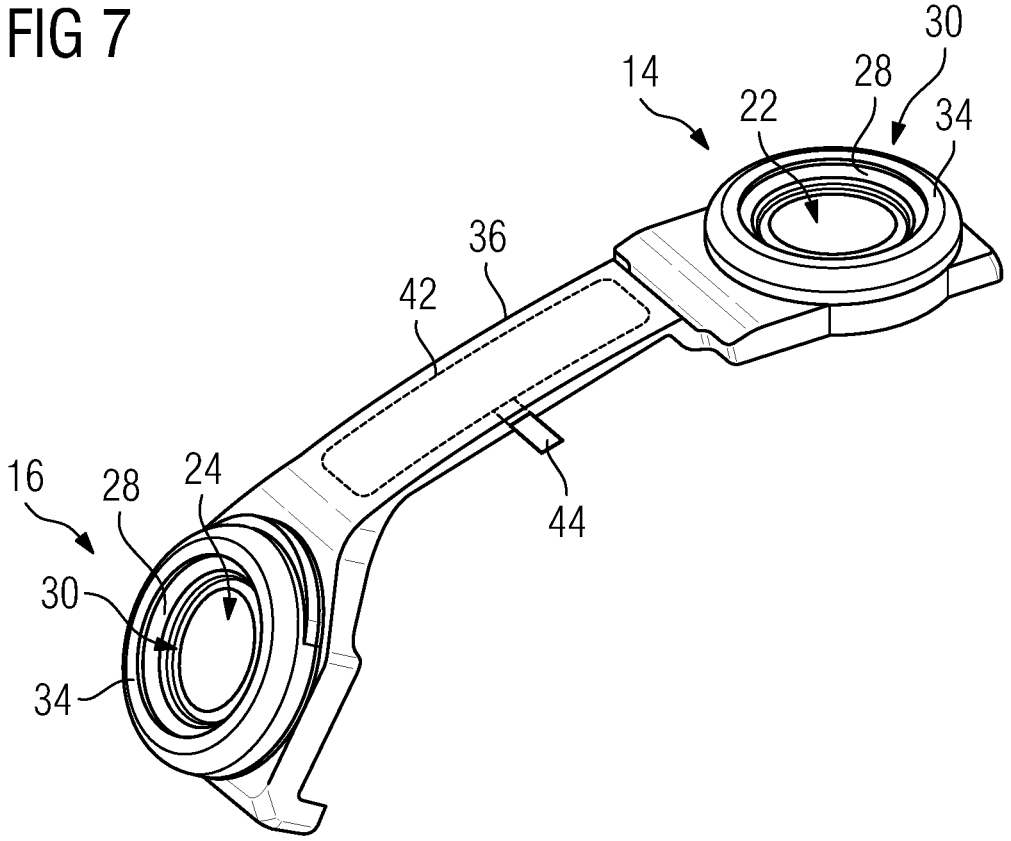
FIG. 7 is a similar view showing a further illustrative embodiment of the damping elements.

42 is cast as a metal insert part into the connecting web 36 between the damping elements 14 and 16, i.e. is encapsulated by the plastic of the two damping elements 14 and 16 by injection molding (see FIG. 7). For electrical contact with the circuit carrier, a contact portion 44 of the antenna 42 is not encapsulated.

The subject matter of the invention is clear from the illustrative embodiments described above. However, the subject matter of the invention is not limited to these illustrative embodiments. Rather, further embodiments of the invention can be derived from the above description by a person skilled in the art. In particular, the individual features of the invention and the design variants thereof that have been described with reference to the various illustrative embodiments can also be combined with one another in another way.

The following is a summary list of reference numerals and the corresponding structure used in the above description of the invention:

1 hearing device
2 microphone
3 microphone
4 environment
6 signal processing unit
8 loudspeaker
10 housing
12 cover
14 damping element
16 damping element
18 microphone opening
20 microphone opening
22 barrier element
24 barrier element
26 membrane
28 frame
30 aperture
32 undercut
34 edge
36 connecting web
38 edge
40 insertion well
42 antenna
44 contact portion

The invention claimed is:

1. A hearing device, comprising:

a housing, said housing having a first microphone opening formed therein;

a first microphone disposed in said housing and communicating through said first microphone opening with an environment of the hearing device for detecting an acoustic signal from the environment of the hearing device;

a first damping element supporting said first microphone against said housing, said first damping element being formed with an aperture corresponding to said first microphone opening; and a first barrier element sealing said first microphone opening against moisture in a sound-transmitting manner;

said first damping element having a pocket wherein said first barrier element is received reversibly, said pocket being an undercut of said aperture, said aperture having, at one end thereof, an edge delimiting said undercut, and said aperture being enlarged at said one end in relation to an opposite end of said aperture;

said first damping element sealing off said first barrier element from said housing around an entire periphery of said first microphone opening;

a second microphone disposed in said housing;

a second damping element and a second barrier element assigned respectively to said second microphone, said second barrier element being received reversibly in a pocket formed in said second damping element; and said first damping element and said second damping element being connected to one another in one piece.

2. The hearing device according to claim 1, wherein said first damping element is made of elastic material.

3. The hearing device according to claim 2, wherein said elastic material is an elastic plastic.

4. The hearing device according to claim 1, wherein said pocket is dimensioned to cause said first barrier element to be braced against said first damping element.

5. The hearing device according to claim 1, wherein said first barrier element comprises a hydrophobic membrane.

6. The hearing device according to claim 1, further comprising an antenna for electromagnetic communication with a separate device, said antenna being integrated in one or both of said first or second damping element.

7. The hearing device according to claim 6, further comprising a circuit carrier carrying a signal processing unit and conductor tracks for electrically contacting said first microphone, said second microphone and said antenna, wherein said antenna is connected by way of a solder connection to an assigned conductor track of said circuit carrier.

8. The hearing device according to claim 1, further comprising an antenna for electromagnetic communication with a separate device, said antenna being integrated in said first or second damping element.

9. The hearing device according to claim 8, further comprising a circuit carrier carrying a signal processing unit and conductor tracks for electrically contacting said first microphone and said antenna, wherein said antenna is connected by way of a solder connection to an assigned conductor track of said circuit carrier.

10. The hearing device according to claim 1, wherein said undercut has a second edge delimiting said undercut, said second edge being at an opposite end of said aperture from said edge, one of said edge or said second edge being shorter than the other in a direction toward the longitudinal axis.

11. A hearing device, comprising:

a housing, said housing having a first microphone opening formed therein;

a first microphone disposed in said housing and communicating through said first microphone opening with an environment of the hearing device for detecting an acoustic signal from the environment of the hearing device;

a first damping element supporting said first microphone against said housing, said first damping element being formed with an aperture corresponding to said first microphone opening; and a first barrier element sealing said first microphone opening against moisture in a sound-transmitting manner;

said first damping element having a pocket wherein said first barrier element is received reversibly, said pocket being an undercut of said aperture, said undercut being opened in a direction transverse to a longitudinal axis of said aperture for defining an insertion well for said first barrier element;

said first damping element sealing off said first barrier element from said housing around an entire periphery of said first microphone opening;

a second microphone disposed in said housing;

a second damping element and a second barrier element assigned respectively to said second microphone, said second barrier element being received reversibly in a pocket formed in said second damping element; and said first damping element and said second damping element being connected to one another in one piece.

12. The hearing device according to claim 11, wherein said pocket is dimensioned to cause said first barrier element to be braced against said first damping element.

13. The hearing device according to claim 11, wherein said first barrier element comprises a hydrophobic membrane.

14. The hearing device according to claim 11, further comprising an antenna for electromagnetic communication with a separate device, said antenna being integrated in one or both of said first or second damping element.

15. The hearing device according to claim 14, further comprising a circuit carrier carrying a signal processing unit and conductor tracks for electrically contacting said first microphone, said second microphone and said antenna, wherein said antenna is connected by way of a solder connection to an assigned conductor track of said circuit carrier.

16. The hearing device according to claim 11, further comprising an antenna for electromagnetic communication with a separate device, said antenna being integrated in said first damping element.

17. The hearing device according to claim 16, further comprising a circuit carrier carrying a signal processing unit and conductor tracks for electrically contacting said first microphone and said antenna, wherein said antenna is connected by way of a solder connection to an assigned conductor track of said circuit carrier.

18. The hearing device according to claim 11, wherein said first damping element is made of an elastic plastic.

* * * * *